US005586369A

United States Patent [19]

Matsuda et al.

[11] Patent Number: 5,586,369

[45] Date of Patent: Dec. 24, 1996

[54] DOUBLE-LAYER SLIDE FASTENER TAPE

[75] Inventors: Yoshio Matsuda; Shunji Akashi; Hiroshi Yoshida, all of Toyama-ken, Japan

[73] Assignee: YKK Corporation, Tokyo, Japan

[21] Appl. No.: 520,857

[22] Filed: Aug. 30, 1995

[30] Foreign Application Priority Data

Aug. 31, 1994 [JP] Japan ..... 6-206208

[51] Int. Cl.[6] ..... A44B 19/00

[52] U.S. Cl. ..... 24/392; 24/381; 24/393

[58] Field of Search ..... 24/391, 392, 393, 24/394, 381

[56] References Cited

U.S. PATENT DOCUMENTS

| | | | |
|---|---|---|---|
| 3,919,744 | 11/1975 | Kandou | 24/393 |
| 3,952,380 | 4/1976 | Takamatsu | 24/393 |
| 3,974,550 | 8/1976 | Fujisaki et al. | 24/393 |
| 4,015,450 | 4/1977 | Matsuda et al. | 24/393 |
| 4,064,602 | 12/1977 | Heimberger | 24/393 |

FOREIGN PATENT DOCUMENTS

| | | |
|---|---|---|
| 34-6608 | 5/1934 | Japan . |
| 57-29601 | 6/1982 | Japan . |
| 61-30494 | 9/1986 | Japan . |

*Primary Examiner*—Victor N. Sakran
*Attorney, Agent, or Firm*—Hill, Steadman & Simpson

[57] ABSTRACT

A slide fastener tape woven or knitted so as to form a coupling element attaching edge portion, a tape body portion and a tape sewing portion arranged in order transversely of the tape, wherein the tape has a double-layer structure portion composed of a front cloth and a back cloth joined together by a connecting yarn with a predetermined gap therebetween extending transversely over a predetermined region of the tape, the connecting yarn being a synthetic resin monofilament or multifilament, the back cloth of the double-layer structure portion being a section formed of at least a mesh woven or knitted fabric.

4 Claims, 5 Drawing Sheets

DOUBLE-LAYER SLIDE FASTENER TAPE

BACKGROUND OF THE INVENTION

1. Field of the Invention

This invention relates to a tape for slide fasteners, and more particularly to a tape suitable for slide fasteners to be directly attached to sportswear, summer wear, shirts, blouses, underwear, etc.

2. Description of the Related Art

In the past, various attempts were made to provide slide fasteners with ventilation. For example, Japanese Utility Model Publication No. Sho 34-6608 discloses a slide fastener tape provided with waterproofness, in which through-holes are formed and attached with eyelets respectively to secure ventilation. Further, it has recently been proposed that vent holes are formed in a tape body portion, which is part of a woven or knitted fastener tape other than an element attaching edge portion and a tape sewing portion, simultaneously with the weaving or knitting of the fastener tape.

According to the fastener tape disclosed in, for example, Japanese Utility Model Publication No. Sho 57-29601, the tape body portion between the element attaching edge portion and the tape sewing portion is woven or knitted in a coarser density than the other portions and then part of the weaving and knitting yarns at suitable positions of the tape body portion is shifted outwardly to form vent holes and at the same time to make the peripheral edges of the vent holes dense in structure, whereupon the peripheral edges are fused by heating and is thereby prevented from fraying. According to Japanese Utility Model Publication No. Sho 61-30494, in the warp-knit fastener tape, a wale-free region defined by strong knitting yarns is formed over part of the tape body portion of the fastener tape, and vent holes are formed at predetermined distances in the wale-free region by laying the strong knitting yarns in the wale-free region.

The slide fastener disclosed in Japanese Utility Model Publication No. Sho 34-6608 not only has a problem in appearance, but also its use is limited to articles requiring waterproofness, such as rain wear. Assuming that the slide fastener disclosed in Japanese Utility Model Publications Nos. Sho 57-29601 or 61-30494 is attached to an article, vent holes or vent portions are necessarily exposed to the surface so that it gives an unsightly appearance. Also functionally, either of the slide fasteners is difficult to attach to a particular kind of articles, such as winter wear. Further, because of the vent holes formed in the tape body portions of the fastener tape, the fastener tape tends to deform at the tape body portion so that it is difficult to secure a stable posture when the slide fastener is sewn to an article and in use.

SUMMARY OF THE INVENTION

It is therefore an object of this invention to provide a woven or knitted slide fastener tape which can secure ventilation and, at the same time, has a sightly appearance fit for various uses. According to the invention, there is provided a slide fastener tape woven or knitted so as to form a coupling element attaching edge portion, a tape body portion and a tape sewing portion arranged in order transversely of the tape, wherein the tape has a double-layer structure portion composed of a front cloth and a back cloth joined together by a connecting yarn with a predetermined gap formed therebetween extending transversely over a predetermined region of the tape, the connecting yarn being a synthetic resin monofilament or multifilament, the back cloth of the double-layer structure portion being a section formed of at least a mesh woven fabric. The predetermined region formed of the double-layer structure portion may be the tape sewing portion or any other portion of the tape except the coupling element attaching edge portion as far as the back cloth of the double-layer structure portion has a mesh structure.

The front cloth and back cloth are connected to each other by the connecting yarn with a predetermined gap while the two cloths are woven or knitted. The front cloth of the double-layer structure portion is woven or knitted in a density equal to that of the ordinary fastener tape, while the back cloth of that portion is woven or knitted so as to have at least a coarse mesh structure, in which case, the other portions or area of the fastener tape may not have a mesh structure. But in order to keep the element attaching edge portion free from deformation such as longitudinal and transverse expansion and shrink, a structure of an element attaching edge portion of the ordinary fastener tape which is woven or knitted in a large density throughout its entire area should be applied. Another important feature of this invention is that the connecting yarn is a synthetic resin monofilament or multifilament having a necessary degree of rigidness. This connecting yarn serves to prevent the front and back cloths from coming into perfect contact with each other. Even if the two cloths are brought into contact with each other by sewing, the connecting yarns existing between the two cloths serve to leave a small vent gap between these cloths.

Assuming that a slide fastener stringer using the above-mentioned fastener tape is attached to, for example, sportswear, perspiration will vapor through the mesh structure of the back cloth toward the front cloth and then radiates through the gap between the two cloths to the outside smoothly so that the slide-fastener-attached portion of a garment is free from growing sticky due to perspiration, thus giving a refreshing touch.

DETAILED DESCRIPTION OF THE PREFERRED EMBODIMENTS

Figure 1:
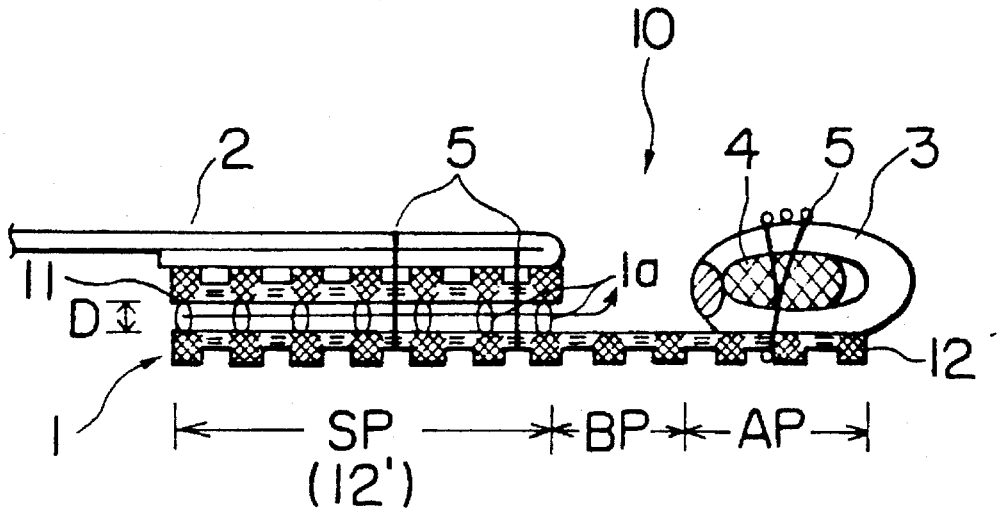
FIG. 1 is a schematic cross-sectional view of a slide fastener tape, showing its structure and function according to a first embodiment of this invention.
Figure 2:
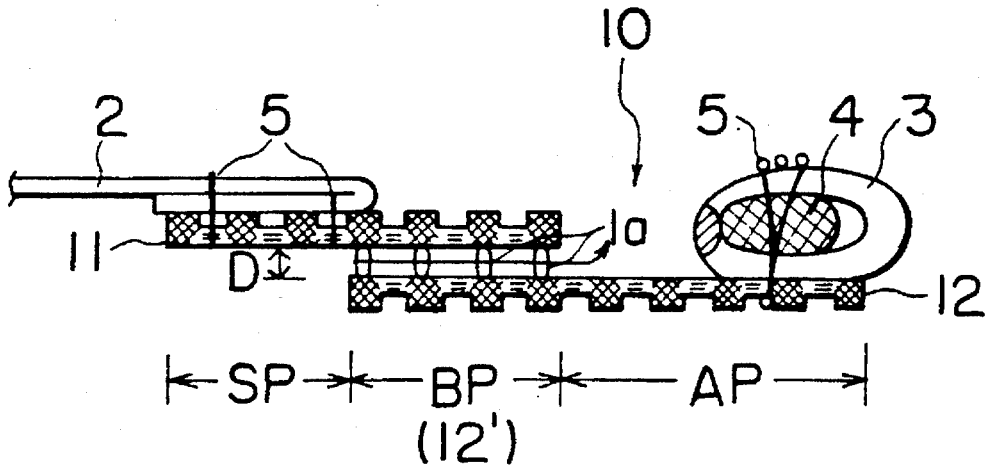
FIG. 2 is a schematic cross-sectional view of another slide fastener tape, showing its structure and function according to a second embodiment of this invention.

Preferred embodiments of this invention will now be described in detail with reference to the accompanying drawings. FIGS. 1 and 2 are schematic cross-sectional views showing different forms of slide fastener tapes and their attaching postures.

In FIGS. 1 and 2, reference numeral 1 designates a fastener tape of this invention; 2, an article, such as clothing, to which a slide fastener is to be attached; 3, coupling elements; 4, a core cord; and 5, a sewing yarn.

The fastener tape 1 comprises a tape sewing portion SP to be attached to the article 2, an element attaching edge portion AP, and a tape body portion BP which is part of the tape 1 other than the tape sewing portion SP and an element attaching edge portion AP. The three portions of the fastener tape 1 are arranged in order in a transverse direction of the tape 1.

In the example of FIG. 1, the tape sewing portion SP has a double-layer structure composed of a front cloth 11 and a back cloth 12, which are joined together by connecting yarns 1*a* with a predetermined gap D while the two cloths 11, 12 are woven or knitted. The front cloth 11 of a double-layer structure portion is woven or knitted in a density equal to that of the ordinary fastener tape, while the back cloth 12 of that portion is woven or knitted so as to have at least a coarse mesh structure, in which case the other portions or area of the fastener tape 1, may not have a mesh structure. But in order to keep the element attaching edge portion AP free from deformation such as longitudinal and transverse expansion and shrink, a structure of an element attaching edge portion of the ordinary fastener tape which is woven or knitted in a large density throughout the entire area should be applied. Another important feature of this invention is that the connecting yarns 1*a* are synthetic resin monofilaments or multifilaments having a necessary degree of rigidness. This connecting yarns 1*a* serve to prevent the front and back cloths 11, 12 from coming into perfect contact with each other. Even if the two cloths 11, 12 are brought into contact with each other by sewing, the connecting yarns 1*a* existing between the two cloths 11, 12 serve to leave a small vent gap between the cloths 11, 12.

Assuming that a slide fastener stringer 10 using the above-mentioned fastener tape 1 is attached to, for example, sportswear, perspiration will vapor through the mesh structure of the back cloth 12 toward the front cloth 11 and then radiates through the gap D between the two cloths 11, 12 to the outside smoothly as indicated by arrows in FIGS. 1 and 2 so that the slide-fastener-attached portion of a garment is free from growing sticky due to the perspiration, thus giving a refreshing touch.

In the example of FIG. 2, the tape sewing portion SP and the element attaching edge portion AP of the fastener tape 1 is identical in structure with those of the ordinary fastener tape, while only the tape body portion BP is a double-layer structure of the front and back cloths 11, 12. The back cloth 12 of a double-layer structure portion is woven or knitted in a mesh structure. In this case, the front cloth 11 of the double-layer structure portion may have the same woven or knit structure as the tape sewing portion SP or may have a mesh structure like the back cloth 12 of that portion. Also in this example, the connecting yarns 1*a* are synthetic resin monofilaments or multifilaments having a necessary degree of rigidness, and a predetermined gap D is defined between the front and back cloths 11, 12. Accordingly, moisture such as perspiration will vapor through the mesh structure of the back cloth 12 toward the front cloth 11 and then radiates through the gap D between the two cloths 11, 12 to the outside soon.

Figure 3:
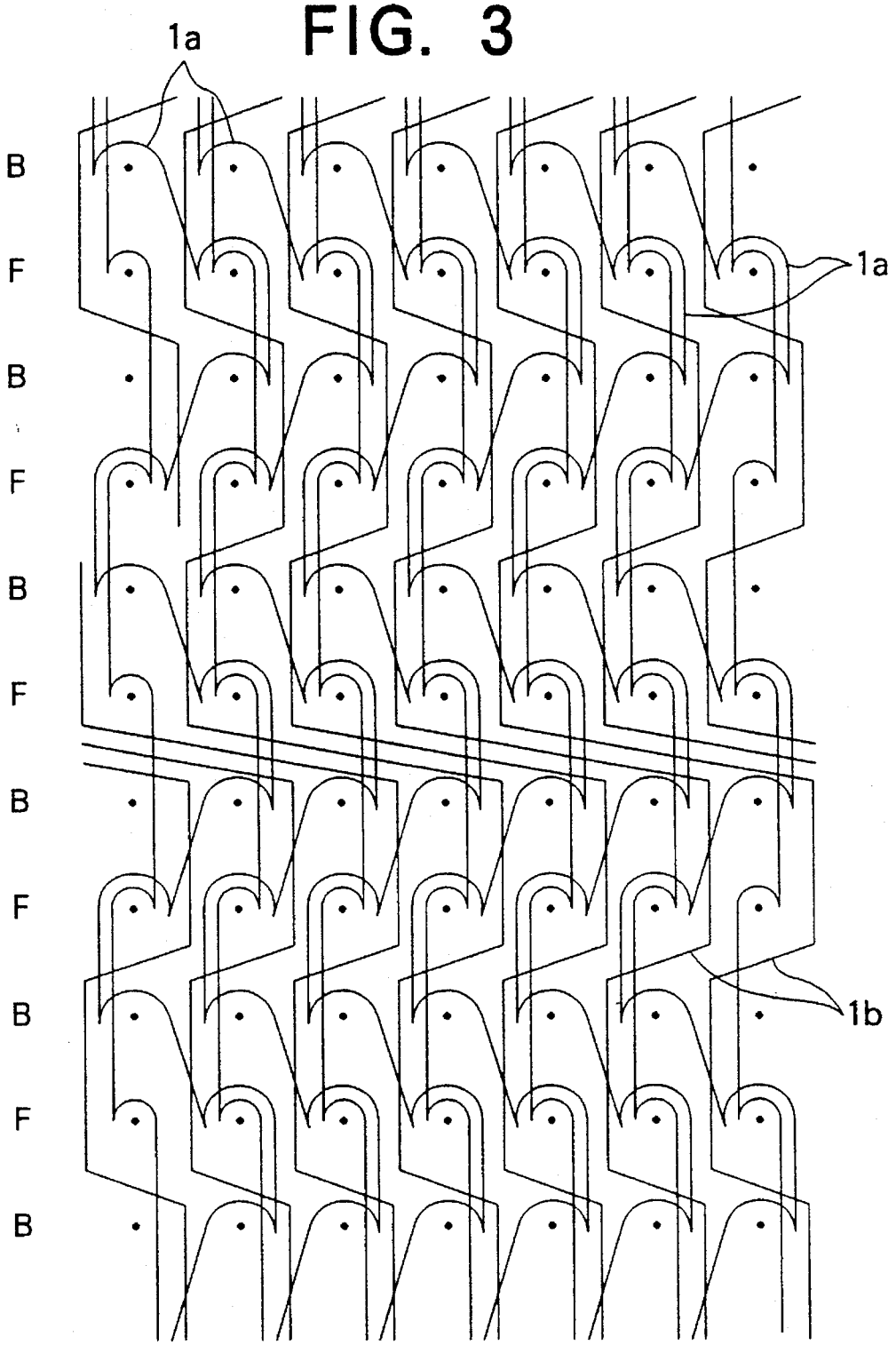
FIG. 3 is a diagram showing lapping movements of a mesh-like knit structure of a knitted fastener tape of this invention.
Figure 4:
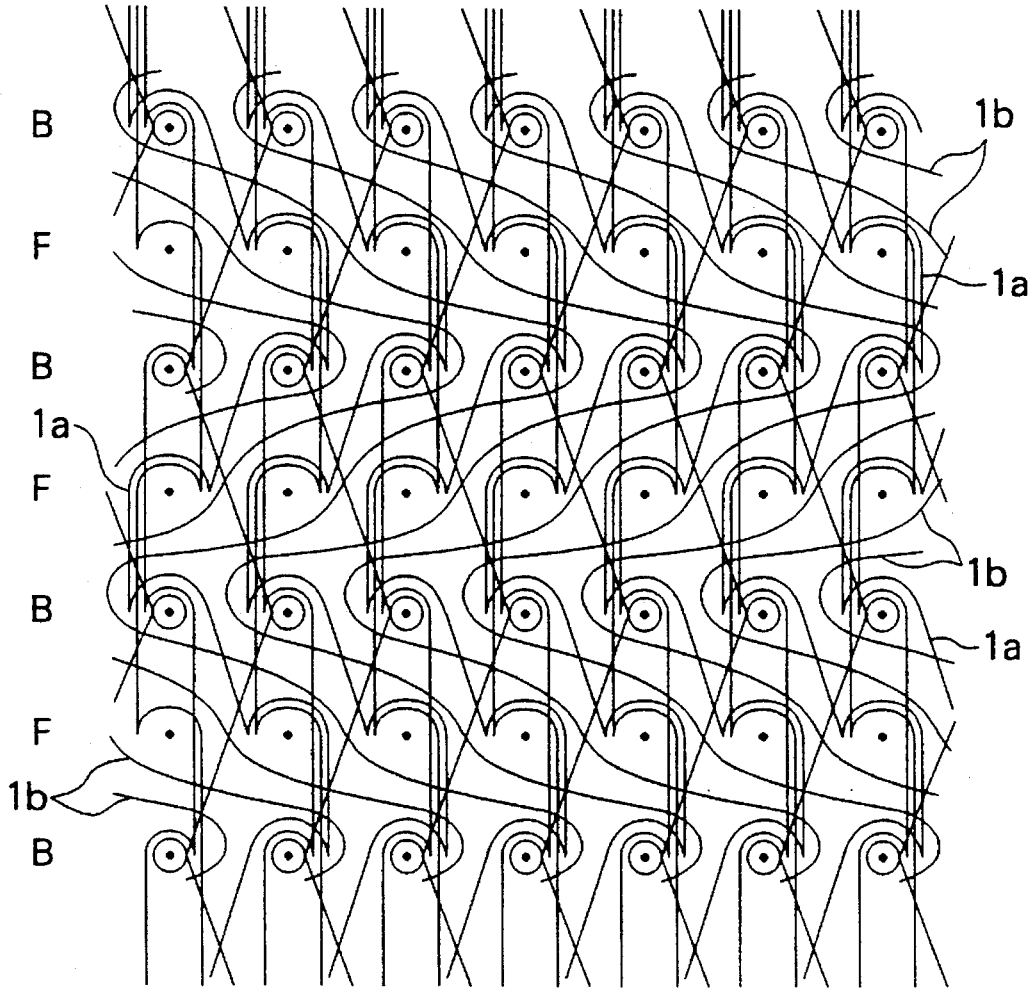
FIG. 4 is a diagram showing lapping movements of a double-layer region of the fastener tape.
Figure 5:
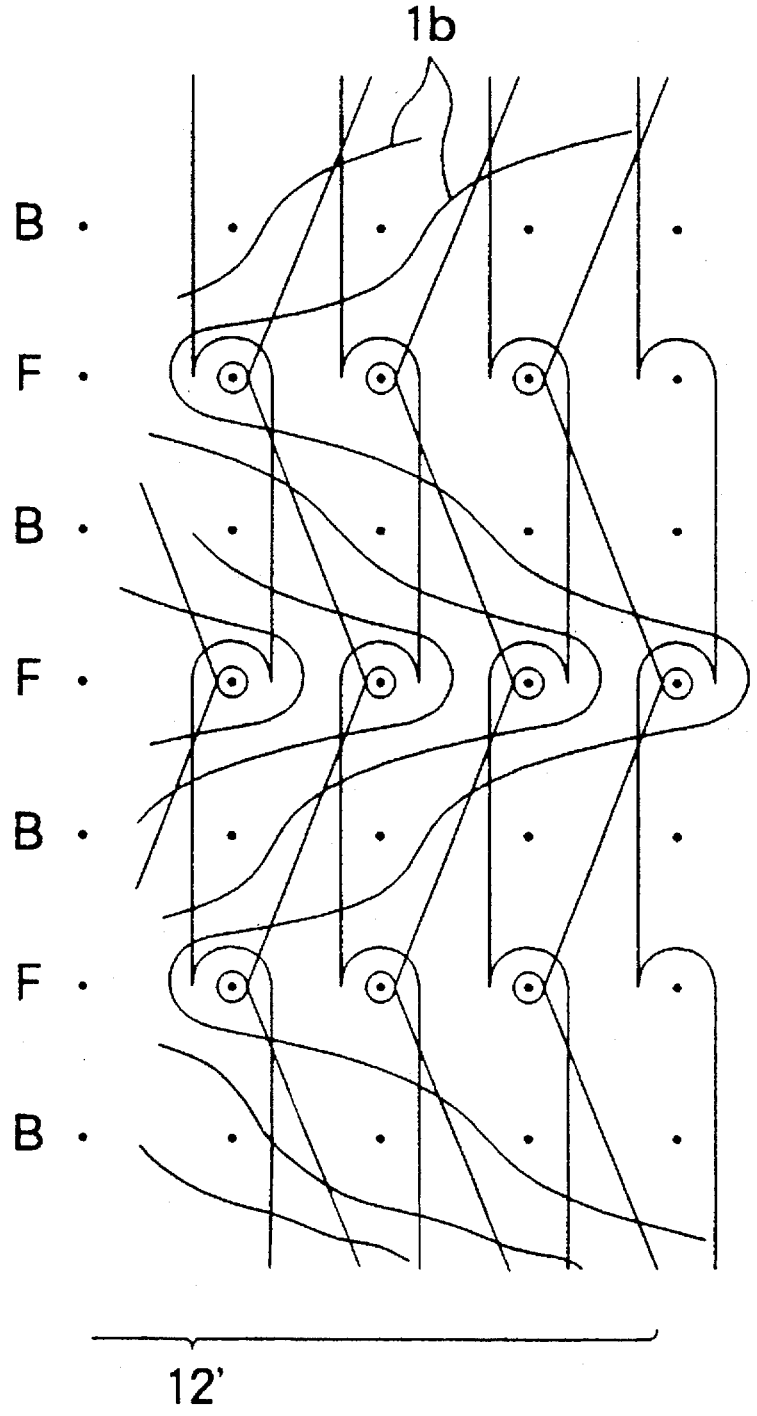
FIG. 5 is a diagram showing lapping movements of an element attaching edge portion of the fastener tape.

FIGS. 3 through 5 show a detailed warp-knit structure of the fastener tape 1 of FIG. 1. FIG. 3 is a diagram showing lapping movements of the mesh structure 12' of the back cloth 12 and also showing the lapping movements of the connecting yarns 1*a*. FIG. 4 is a diagram showing lapping movements of the double-layer structure portion composed of the front and back cloths 11, 12 joined together by the connecting yarns 1*a*. In-laid yarns 1*b* are laid in the mesh structure 12'. FIG. 5 is a diagram showing lapping movements of a warp-knit structure of the element attaching edge portion AP.

According to the illustrated examples, in the double-layer structure portion of the front and back cloths 11, 12 joined together by the connecting yarns 1*a*, the front cloth 11 is knitted by back knitting needles B, while the back cloth 12 is knitted by front knitting needles F. The front cloth 11 is a warp-knit structure composed of chain stitches, tricot stitches of 1-0/1-2 and an in-laid structure of 0-0/4-4, which are knitted simultaneously to obtain a high-density cloth. The mesh structure 12' of the back cloth 12 has a marquisette-like or tulle knit structure as shown in FIG. 3. The in-laid yarns 1*b* having a desired structure is laid in the chain stitches to obtain a mesh structure such as a lace.

The front and back cloths 11, 12 respectively knitted by the back and front needles B, A are joined together by the connecting yarns 1*a*. As shown in FIGS. 3 and 4, the connecting yarns 1*a* are knitted on the back side in a pattern of 1-0, then on the front side in a pattern of 0-1 to connect the front and back cloths 11, 12, and then on the front side in a pattern of 1-2 to connect the front and back cloths 11, 12 diagonally, whereupon they are returned on the front side in a pattern of 2-1 and on the back side in a pattern of 1-0 and thereafter the same knitting patterns are repeated. Thus each of the connecting yarns 1*a* connects the front and back cloths 11, 12 at every stitch on either the back side or the front side. Further, in this invention, the connecting yarns 1*a* connect the front and back cloths 11, 12 with a predetermined length therebetween to define a predetermined gap D. The connecting yarns 1*a* are synthetic resin monofilaments or multifilaments, which are preferably more rigid than the other yarns. Therefore, also in the case where multifilaments are used, it is preferable that the filaments should be large in size and should be reduced in number.

The entire element attaching edge portion AP of the fastener tape 1 is knitted by the front needles F as shown in FIG. 5. The knit structure of the element attaching edge portion AP comprises chain stitches, tricot stitches of 1-0/1-2 and an in-laid structure of 0-0/4-4, which are knitted simultaneously. This knit structure is reverse to that of the front cloth 11.

Also the fastener tape 1 of FIG. 2 may be knitted in the same knit structure as that of FIG. 1. However, the knit structure in each of the tape sewing portion SP, the tape body portion BP and the element attaching edge portion AP, especially the double-layer structure and its mesh structure may be modified as desired. As long as the mesh structure 12' of the back cloth 12 is knitted and the element attaching edge portion AP is knitted at a high density without having a double-layer structure, a variety of selections including kinds of knitting yarns may be made. Further, the connecting yarns 1*a* may be knitted between the front and back cloths 11, 12, skipping every one or more stitches.

Figure 6:
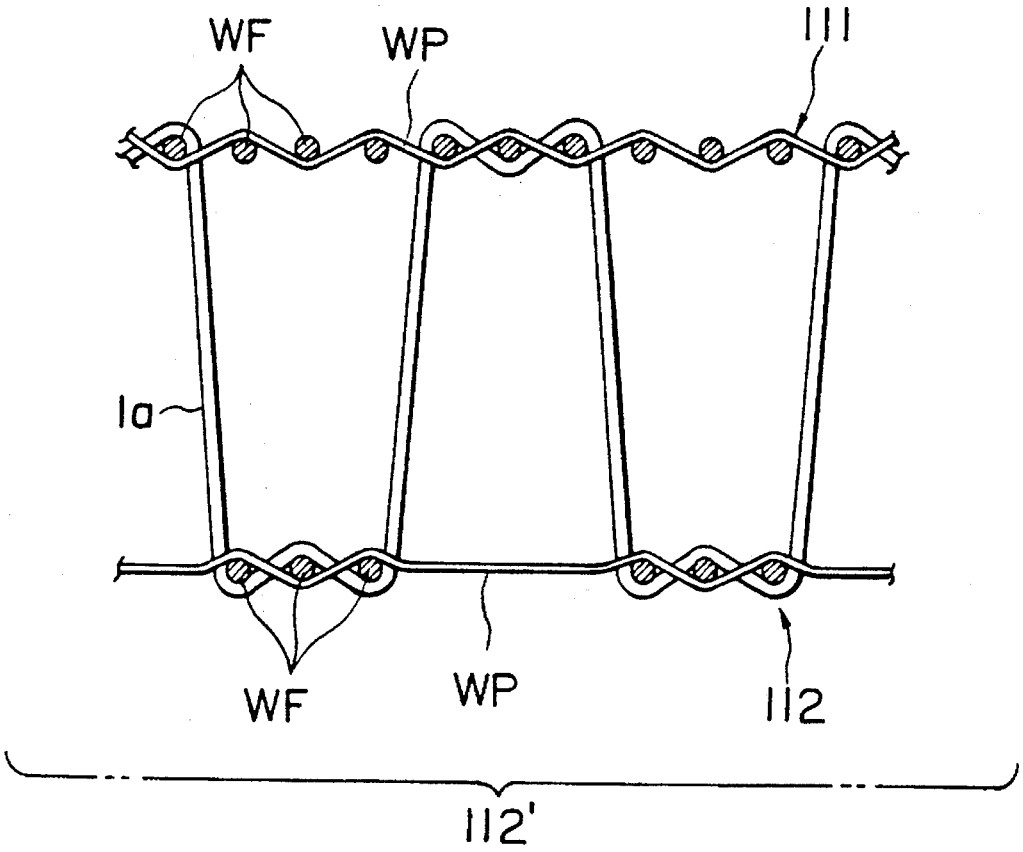
FIG. 6 is a fragmentary enlarged cross-sectional view of a double-layer region of a woven fastener tape of this invention.

FIG. 6 is a cross-sectional view showing a double-layer woven structure of a woven fastener tape 1 according to this invention. This woven structure is obtained in the same method as that for the weaving of a cut-pile woven fabric by the ordinary shearing, and the front and back cloths 111, 112 are joined by connecting yarns 1*a*. According to this illustrated example, the front cloth 111 has a plain-woven structure, and the back cloth 112 has a woven mesh structure by a twist structure. The connecting yarns 1*a* are arranged in a suitable pattern along with warp yarns WP of the front and back cloths 111, 112; they are woven simultaneously with three weft yarns WF of the front cloth 111 and then with three weft yarns WF of the back cloth 112, whereupon they are woven again with the front cloth 111 to repeat the same weave pattern.

The connecting yarns 1*a*, like those in the warp-knit fastener tape, may be monofilaments, or multifilaments relatively large in size and small in number. The warp yarns WP to be used in the mesh structure 112' of the back cloth 112 may be a combination of monofilaments and multifilaments, or strong twist yarns in order to stabilize the mesh form. Accordingly, also in the woven fastener tape 1, like the knitted fastener tape 1, the front cloth 111 may apply various weave forms in appearance, and since the back cloth 112 connected with the front cloth 111 by the connecting yarns 1*a* has a mesh structure, ventilation is secured so that no perspiration due to, for example, hard exercise will not gather on the back side of the slide fastener to keep that area from becoming sticky.

As is apparent from the foregoing description, according to the fastener tape, a predetermined region extending transversely of the tape has a double-layer woven or knitted structure portion composed of front and back cloths joined together by the relatively rigid connecting yarns, and the back cloth of the double-layer structure portion has a mesh structure. With this arrangement, assuming that a slide fastener stringer using the above-mentioned fastener tape is attached to, for example, sportswear or underwear which requires ventilation, perspiration will vapor through the mesh structure of the back cloth toward the front cloth and then radiates through the gap between the two cloths to the outside smoothly so that the slide-fastener-attached portion of a garment is free from growing sticky due to perspiration, thus giving a refreshing touch. Further, since tile front cloth can be woven or knitted according to the kind of article to which the slide fastener is to be attached, it is possible to meet various demands.

What is claimed is:

1. A slide fastener tape woven or knitted so as to form a coupling element attaching edge portion, a tape body portion and a tape sewing portion arranged in order transversely of said tape, wherein said tape has a double-layer structure portion composed of a front cloth and a back cloth joined together by a connecting yarn with a predetermined gap therebetween extending transversely over a predetermined region of said tape, said connecting yarn being a synthetic resin monofilament or multifilament, said back cloth of the double-layer structure portion being a section formed of at least a mesh woven or knitted fabric.

2. A slide fastener tape according to claim 1, wherein said predetermined region of the double-layer structure portion is the tape sewing portion.

3. A slide fastener tape according to claim 1, wherein said predetermined region of the double-layer structure portion is the tape body portion.

4. A slide fastener tape according to claim 1, wherein said predetermined region of the double-layer structure portion is the tape sewing portion and the tape body portion.

* * * * *